US008371743B2

(12) United States Patent
Zwirner

(10) Patent No.: US 8,371,743 B2
(45) Date of Patent: Feb. 12, 2013

(54) METHOD FOR SUSPENDING OR RE-SUSPENDING PARTICLES IN A SOLUTION AND APPARATUS ADAPTED THERETO

(75) Inventor: Daniel Zwirner, Jona (CH)

(73) Assignee: Qiagen GmbH, Hilden (DE)

( * ) Notice: Subject to any disclaimer, the term of this patent is extended or adjusted under 35 U.S.C. 154(b) by 481 days.

(21) Appl. No.: 12/673,099

(22) PCT Filed: Aug. 14, 2008

(86) PCT No.: PCT/EP2008/060720

§ 371 (c)(1),
(2), (4) Date: Feb. 11, 2010

(87) PCT Pub. No.: WO2009/021998

PCT Pub. Date: Feb. 19, 2009

(65) Prior Publication Data

US 2011/0205835 A1 Aug. 25, 2011

(30) Foreign Application Priority Data

Aug. 14, 2007 (EP) ..... 07015986

(51) Int. Cl.
*B01F 13/08* (2006.01)

(52) U.S. Cl. ..... 366/273

(58) Field of Classification Search ..... 366/129, 366/273, 274, 342, 343; 99/277.2; 435/302.1; 416/3; 210/695

See application file for complete search history.

(56) References Cited

U.S. PATENT DOCUMENTS
(Continued)

FOREIGN PATENT DOCUMENTS

DE 4421058 12/1995
DE 19803477 C1 * 9/1999
(Continued)

OTHER PUBLICATIONS

International Search Report of PCT/EP20081060720, completed Dec. 8, 2008.

*Primary Examiner* — Charles E Cooley
(74) *Attorney, Agent, or Firm* — Baker Donelson Bearman, Caldwell & Berkowitz, PC

(57) ABSTRACT

A method for suspending or re-suspending magnetically attractable particles is provided. In the present method at least a mixing vessel (10) is provided filled at least partially with a mixture (30) containing magnetically attractable particles (40) at least partially precipitated at the bottom (11) of the mixing vessel (10). An effective magnetic field acting at least in the front end area (3) of the mixing bar (1) is switched on by the magnetic field generating apparatus (4) while the mixing bar (1) is immersed in the mixture (30). Subsequently, the magnetic field is moved away from the bottom (11) of the mixing vessel (10) along with the mixing bar, whereby the movement of the magnetic field along with the mixing bar is carried out such that at least a part of the magnetically attractable particles (40) is raised from the bottom (11) of the mixing vessel (10) and the portion of the particles sticking to the bar is minimized. The magnetic field is switched off in a predefined distance from the bottom which is greater than the distance from the bottom at the time when the magnetic field is switched on. Thereafter, repeated mixing movements of the mixing bar (1) are carried out until the magnetically attractable particles present in the mixture (30) are sufficiently suspended or re-suspended whereby a magnetic field which is switched on does not exist at the front end (3) of the mixing bar (1).

19 Claims, 8 Drawing Sheets

U.S. PATENT DOCUMENTS

| | | | | |
|---|---|---|---|---|
| 3,219,318 | A * | 11/1965 | Hershler | 366/273 |
| 5,942,124 | A | 8/1999 | Tuunanen | |
| 6,207,463 | B1 * | 3/2001 | Tuunanen | 436/526 |
| 6,382,827 | B1 * | 5/2002 | Gebrian | 366/274 |
| 6,390,660 | B1 * | 5/2002 | Colin | 366/116 |
| 6,403,038 | B1 * | 6/2002 | Heermann | 422/527 |
| 6,448,092 | B1 * | 9/2002 | Tuunanen | 436/526 |
| 7,658,854 | B2 * | 2/2010 | Oder et al. | 210/695 |
| 8,052,875 | B2 * | 11/2011 | Oder et al. | 210/695 |
| 2005/0013741 | A1 * | 1/2005 | a' Brassard | 422/99 |
| 2006/0118494 | A1 | 6/2006 | Rundt et al. | |
| 2009/0027998 | A1 * | 1/2009 | Halaka et al. | 366/341 |
| 2010/0159556 | A1 * | 6/2010 | Rida | 435/173.7 |
| 2010/0200511 | A1 * | 8/2010 | Oder et al. | 210/695 |
| 2010/0282685 | A1 * | 11/2010 | Halaka et al. | 210/695 |
| 2011/0205835 | A1 * | 8/2011 | Zwirner | 366/273 |

FOREIGN PATENT DOCUMENTS

| | | | |
|---|---|---|---|
| DE | 10331254 | | 2/2005 |
| DE | 102005004664 | | 8/2006 |
| EP | 1621890 | | 2/2006 |
| EP | 2033715 | A1 * | 3/2009 |
| JP | 2000-254472 | * | 9/2000 |
| WO | 9418565 | | 8/1994 |
| WO | 9715366 | | 5/1997 |
| WO | 9942832 | | 8/1999 |
| WO | 0240173 | | 5/2002 |
| WO | 2004035217 | | 4/2004 |
| WO | 2005044460 | | 5/2005 |
| WO | 2006010584 | | 2/2006 |

* cited by examiner

METHOD FOR SUSPENDING OR RE-SUSPENDING PARTICLES IN A SOLUTION AND APPARATUS ADAPTED THERETO

CROSS REFERENCE TO RELATED APPLICATIONS

This application is a §371 National Stage Application of PCT/EP2008/060720 filed Aug. 14, 2008, which claims priority to European Application 07015986.8 filed Aug. 14, 2007.

BACKGROUND OF THE INVENTION

1. Field of the Invention

The invention is related to a method for suspending particles, especially magnetically attractable particles and beads such as ferro-and/or paramagnetic particles, for example in a liquid mixture used for diagnostic or analytical purposes.

2. Description of Related Art

In the field of sample preparation and sample processing for analytical or diagnostic studies, processes are increasingly used depending on utilisation of magnetically attractable particles, to which either particularly biological target molecules or contaminants can bind. Magnetically attractable particles can be separated from the mixture they are suspended in by appropriate magnetic fields. This particularly applies to automated processes, thus allowing a great number of samples to be analysed in a short time without extensive steps of centrifugation. This allows a large sample turnover and permits to reduce considerably the complexity of extensive and particularly parallel studies. Important fields of application are the purification of biological or medical samples, generally the separation and isolation of particularly biological target molecules, medical diagnostics, and pharmaceutical screening methods for the identification of potential pharmaceutical agents.

Methods for the separation of magnetically attractable particles are disclosed for example in DE 44 21 058, DE 103 31 254, DE 10 2005 004 664, WO 94/18565, WO 99/42832, WO 02/40173, WO 2005/044460, U.S. Pat. No. 5,942,124 and U.S. Pat. No. 6,448,092. The basic principle of the methods described there depends on the fact that a separation apparatus, for example a magnetic bar, is immersed in a usually liquid mixture and that the magnetically attractable particles in the mixture are concentrated on the surface of the separation apparatus by effect of the magnetic field. Thereafter, the separation apparatus with the adherent particles is removed from the liquid.

The application of external magnetic fields for mixing and separating magnetic particles is described in WO 2006/010584. For this purpose, pole shoes are arranged around an especially designed mixing vessel, so that changeable magnetic fields can be produced.

For mixing particles it is also known to use mixing bars, setting the mixture in motion by rotation, as e.g. described in US 2006/0118494, and thereby whirling the particles in the mixture. However, rotational solutions are very extensive, particularly in automated parallel processing.

Particularly when the magnetic particles come into contact with multiple solutions during separation and/or purification processes, for example in binding or washing processes, there are often losses in yield of the target molecules binding to the magnetic particles or insufficient purification results, if the particles in the solutions or mixtures are not sufficiently suspended, but precipitate at the bottom. In addition, particles used in such processes per se show a high tendency for sedimentation. Therefore, efforts are being made in the described processes in order to keep the magnetic particles at least temporarily in the balance by mechanical mixing movements or to re-suspend the precipitated particles, respectively.

One problem appearing during practical application of the processes of the state of the art is that the particles coated with the target molecules, particularly the biological target molecules, or the contaminants no longer stick to the magnet as particles during production of a magnetic field and direct or indirect collection of the magnetic particles at the magnet, but rather as clumps or flakes, respectively. This results in that the particles can only be suspended badly and re-precipitate very quickly after being released from the magnet for example for washing the particles or eluting the adherent components. This can also lead to bad purification results.

SUMMARY OF THE INVENTION

Therefore, it is the problem of the present invention to provide for a method for suspending or re-suspending in particular precipitated particles in a solution as easily as possible.

This problem is solved by a method for suspending or re-suspending, respectively, magnetically attractable particles. The method includes the steps:

- Providing of at least one mixing vessel filled at least partially with a mixture containing magnetically attractable particles which are at least partially precipitated at the bottom of the mixing vessel;
- Providing at least one mixing bar with a front end directed to the bottom of the mixing vessel, wherein the mixing bar has a magnetic field generating apparatus for the optional generation of a magnetic field at least in the front end area;
- Switching on an effective magnetic field acting at least in the front end area of the mixing bar by means of the magnetic field generating apparatus, while the mixing bar is immersed in the mixture;
- Moving away the magnetic field from the bottom of the mixing vessel with the movement of the magnetic field being such that at least a part of the magnetically attractable particles is raised from the bottom of the mixing vessel, and that the portion of particles sticking at the mixing bar is minimized;
- Switching off the magnetic field in a previously determined distance from the bottom which is greater than the distance from the bottom when switching on the magnetic field;
- Performing repeated mixing movements of the mixing bar without the existence of a magnetic field switched on at the front end of the mixing bar in order to suspend or re-suspend, respectively, the magnetically attractable particles present in the mixture.

DETAILED DESCRIPTION OF A PREFERRED EMBODIMENT

In the context of the present description "magnetically attractable particles" are to be understood as such particles and beads that can be attracted by a magnetic field. Examples therefore are particles and beads possessing ferro-, ferri-, paramagnetic and/or superparamagnetic materials as well as magnetizable materials. The magnetic or magnetizable particles mostly show at least partially a surface made of a non-magnetic or magnetizable material finally causing the binding of the biological target molecules or contaminants The size of such particles can range from about 500 nm to about 25 μm.

The mixing vessel can particularly be any vessel typically used in the field of analytics and diagnostics. For example, it can be a single separate and independent reaction vessel for chemical, biological and/or medical applications or a reaction vessel, which forms a unit with one or more further reaction vessels usually of the same type, for example in the form of a so called multiwellplate. The reaction vessels can be combined in a stackable plate. Such plates are generally used in the field of biotechnology for the manual or automated purifications of biological samples or isolations of specific components, respectively, for example nucleic acids or proteins, or for downstream-processes like assays, PCR or the like. In doing so any reaction or mixing vessel can contain a mixture comprising magnetically attractable particles. The mixtures can contain additional substances, for example dissolved or suspended.

Generally the magnetic particles are added to an untreated or pre-treated sample as powder or suspension. At first the particles mostly sink to the bottom. This should also be the case when the magnetic particles are present in the form of a suspension and the sample or a mixture is added. Typically at the point in time when applying the method according to the invention the magnetically attractable particles are predominantly located at the bottom of the mixing vessel, i.e. the particles are precipitated. In this case the particles in the mixture are re-suspended. On the other hand it is possible that the powder-like particles are present in the mixing vessel before a sample or mixture, respectively, is added. In this case the method is used to suspend the magnetically attractable particles accumulated at the bottom of the mixing vessel.

The mixing bar used for suspending or re-suspending, respectively, has at least one magnetic field generating apparatus. The function of this apparatus is to produce optionally an effective magnetic field particularly at the front end area of the mixing bar optionally, i.e. an effective magnetic field can be switched on and off there. By "switching on" the magnetic field at a site it is meant that an effective magnetic field is generated at this site (for example by switching on a solenoid (electromagnet) located there) or that a magnetic field is transported to this site (for example by moving a permanent magnet). Under the latter conditions the magnetic field is considered as being switched on only when the total magnetizing force is active at the site, i.e. if the magnetic field is still moving to the site it is not considered as being switched on yet. On the other hand the term "switching off" means that no effective magnetic field is generated any more in the front end area or a previously generated magnetic field is removed, respectively. A magnetic field is "effective" in the sense of the present invention when it enables the particles in the mixture to be moved and particularly to be drawn to the mixing bar. "Switching on" and "switching off" refer therefore to the optional generation of a magnetic field particularly in the front end area of the mixing bar. Generally, the magnetic field can not only be generated in the front end area of the mixing bar, but it can also expand over the length of the bar. However, it should be preferably avoided that the pole of the magnet being opposite to the front end of the mixing bar is immersed into the mixture as well. It goes without saying that the strength of the required magnetic field must be selected depending on the viscosity of the solution as well as the size, weight and the magnetic material of the particles.

Using the mixing bar which is already immersed into the solution or being brought into the solution, the particles on the bottom of the mixing vessel are initially drawn from the bottom towards the front end of the mixing bar. This takes place e.g. by moving the front end of the mixing bar towards the bottom of the mixing vessel preferably along with the apparatus generating the magnetic field. It is however not only unnecessary, but even undesired for reasons of construction and process safety that the front end of the mixing bar contacts the bottom. Particularly when the front end of the mixing bar is located close to the bottom and therefore close to the particles located there, a magnetic field is generated by the magnetic field generating apparatus in the front end area drawing the particles towards the mixing bar. Optionally, the mixing bar can be moved towards the bottom of the mixing vessel along with the magnetic field generating apparatus that is already generating a magnetic field, or a magnetic field generating apparatus already generating a magnetic field can be moved towards the front end of the mixing bar that is already positioned close to the bottom of the mixing vessel. The magnetic field generating apparatus is then at least partially pulled away from the bottom out of the mixture, preferably along with the mixing bar. Particularly the strength of the generated magnetic field as well as the acceleration and the velocity with which the magnetic field is pulled out of the mixture should be preferably coordinated such that the precipitated magnetic particles move from the bottom into the mixture, but do not necessarily stick to the mixing bar.

This is preferably accomplished due to the fact that the magnetic field is always in motion and retention times are minimized particularly close to the bottom. Using a permanent magnet this can be achieved by the magnet initially moving towards the bottom (whether along with the mixing bar or towards the front end of the mixing bar present there). When the magnet is at an adequate distance to the bottom so that the particles can be attracted by the magnetic field, a reversal of motion of the magnet takes place and the magnet is again moved away from the bottom along with the mixing bar. The retention time of the magnet close to the bottom should be exactly chosen such that the particles are moving towards it, but preferably do not totally concentrate at the mixing bar at least. The adhesion of a part of the particles at the mixing bar can generally not be totally avoided, even with careful adjustment of conditions, but the portion should be kept as small as possible. The minimal distance of the mixing bar to the bottom is preferably 0.1 to 2 mm, more preferably 0.3 to 1 mm and most preferably 0.5 to 0.6 mm. The minimal distance of the magnet to the inner tip of the bar before the reversal of motion of the magnet is preferably >0 to 10 mm, more preferably 0.3 to 8 mm and most preferably 0.5 to 5 mm. Thereby the above specified ranges of distance from the bottom (distal) end of the magnet to the bottom (distal) inner end of the mixing bar preferably comprise both the instance that both have parallel running contours as well as different contours at their bottom end.

By using solenoids, they can be switched on already at a large distance from the bottom. Under these circumstances the first step of the process, that is the raising the particles, proceeds preferably according to the first step using the permanent magnet. Is the solenoid not activated until it is close to the bottom, the movement of the magnetic field should take place along with the mixing bar away from the bottom directly after generating the magnetic field and accelerating the particles towards the mixing bar.

Preferably the retention time of the activated magnet with a field strength in the range of 0.5 to 1.5 T at the site where the distance of the mixing bar with integrated magnet to the bottom is minimal (preferably 0.1 to 2 mm, more preferably 0.3 to 1 mm and most preferably 0.5 to 0.6 mm) should be 0.02 to 5 s, more preferably 0.04 to 3 s, still more preferably 0.1 to 0.5 s and most preferably 0.2 s. Using a permanent magnet the traverse path of the magnet should initially show an acceleration of the unmoved magnet to a traverse speed (preferably $a_1*t_1$) towards the bottom of the vessel with the magnet being accelerated either along with the mixing bar or towards the mixing bar which is already closer to the bottom of the vessel. Optionally, the magnet can further on have a constant traverse speed $a_1*t_1$ directed towards the bottom of the vessel with the magnet again moving simultaneously with the mixing bar or towards the mixing bar. Subsequently, the magnet is accelerated with a negative acceleration (preferably $a_2*t_2$) to a speed of 0. This negative acceleration can follow directly after the positive acceleration as well. Accordingly the mixing bar can be negatively accelerated as well or it has already been accelerated to a speed of 0 previously. After traversing this path the magnet and the mixing bar should be preferably at a speed of 0 at the position where the distance from magnet and mixing bar, respectively, to the bottom of the vessel is minimal This traverse path is preferably based upon the following function:

$$s(t)=\tfrac{1}{2}a_1*t_1^2+a_1*t_1*t_3+\tfrac{1}{2}a_2*t_2^2,$$

with $a_1$ being the acceleration of the magnet or the mixing bar, respectively, $t_1$ the time necessary to reach the traverse speed of the magnet or the mixing bar, respectively, towards the bottom of the vessel, $t_3$ the time with a constant traverse speed towards the bottom of the vessel, $t_2$ the time necessary to reduce the traverse speed of the magnet or the mixing vessel, respectively, towards the bottom of the vessel to 0, and s being the covered distance, and where preferably $a_1=-a_2$ and $t_1=t_2$. Thereby the traverse path of the mixing bar can be parallel to that of the magnet or different from that. The function which the traverse path of the mixing bar is based upon should correspond to that of the magnet, with the specific parameters for the magnet and the mixing bar showing different values. If the traverse paths for magnet and mixing bar are different, it should be at least ensured that, if the magnet has reached its position with a minimal distance to the bottom of the vessel and with the speed 0, also the mixing bar shows a minimal distance to the bottom of the vessel and has the speed 0.

Thereafter, the above specified retention time of the magnet follows preferably in a minimal distance to the bottom whereupon the magnet along with the mixing bar preferably passes through a traverse path analogous to the one above mentioned but directed towards the opening of the vessel. The periods $t_1$ and $t_2$ of the accelerations preferably range from 0.02 to 5 s, more preferably from 0.04 to 3 s and still more preferably from 0.1 to 0.5 s.

However, it is also thinkable, that the traverse path described above is independently represented for the mixing bar as well as for the magnet by functions other than that for example mentioned above provided that the operating sequence of downward movement, stopping at a minimal distance from the bottom of the vessel, retention time, and upward movement is generally in accordance as described above.

Using a solenoid that is switched on before it has reached the minimal distance to the bottom, the traverse path should be analogous to that for the permanent magnet. Using a solenoid that is not switched on until it has reached the minimal distance to the bottom, the traverse path should correspond to the traverse path of the permanent magnet towards the opening of the vessel as described above.

Provided that the particles are raised up sufficiently, for example to a selected height, they are released, i.e. the direction of movement of the particles is no longer influenced by the magnetic field. This takes place preferably by switching off the magnetic field or removing the magnetic field generating apparatus from the mixing bar. At the same time as the particles are released or shortly afterwards, the mixing bar is set in a mixing movement distributing the particles in the solution as homogeneously as possible. The mixing movement typically is a repeated raising and lowering of the mixing bar, i.e. a vertical movement of the mixing bar. Generally a rotating movement or a combination of vertical and rotating movement of the mixing bar is possible as well. The number of mixing procedures is not defined and is usually determined by the operator depending on which degree of homogeneous distribution of the particles in the mixture is desired. Therefore, the particles are preferably sufficiently suspended or re-suspended, respectively, if the degree of suspending or re-suspending is up to the standard of the operator or is consistent, respectively, with the best possible suspending or re-suspending of the particles in the present system. In most cases the particles will be sufficiently suspended, if the portion of the re-precipitated particles after raising and suspending is still relatively small.

Experiments have shown that the precipitated particles can effectively be raised from the bottom and suspended or re-suspended, respectively, in the solution using the method according to the invention. Therefore, this is preferably not a separation process in the truest sense of the word with the particles being held as quantitatively as possible at the magnet or at a bush surrounding it and being removed from the mixing vessel, but the particles are just to be re-suspended particularly to achieve an optimal bond, washing effect, elution or the like. The magnetic field is preferably used just to raise the precipitated particles, while the distribution of the particles in the solution by the mixing movement of the mixing bar takes place with the magnetic field being switched off.

Thus, the method according to the invention has the advantage that the mere distribution of the particles already raised from the bottom can occur by comparatively gentle mixing movements. A whirling up of the precipitated particles exclusively by strong mixing movements as it would be necessary without using a magnetic field is not required. Therefore, with the method according to the invention the solution does not have to be moved very strongly, so that the danger of cross-contamination of adjacent mixing vessels during automated parallel processing is significantly minimized.

Moreover, with the method according to the invention the mixing bar does not have to be taken totally to the bottom in order to raise the precipitated particles, but merely has to be taken close to the bottom. Thus impacts of the mixing bar against the bottom of the mixing vessel are avoided. By whirling up the precipitated particles exclusively by a mixing movement of the mixing bar and without using a magnetic field, the mixing bar has to be taken directly to the bottom, since otherwise there is a risk that a majority of the particles is not whirled up. Particularly in vessels without a flat bottom a mere mechanical mixing can cause the particles not to be suspended or re-suspended but rather to be pressed against the bottom. In addition, such a mere mechanical method of re-suspending requires a high complexity of design-engineering to eliminate or to minimize, respectively, collisions between bottom and mixing vessel and associated damage of the bottom and a discharge of the mixture.

The above mentioned problem can be solved according to another embodiment by a method for suspending or re-suspending, respectively, magnetically attractable particles. Thereby the method comprises:

Providing at least one mixing vessel filled at least partially with a solution in which magnetically attractable particles are precipitated at the bottom of the mixing vessel;

Providing at least one mixing bar with a front end directed towards the bottom of the mixing vessel, whereby the mixing bar comprises a magnetic field generating apparatus for the optional generation of a magnetic field in the front end area;

whereby at least a part of the magnetically attractable particles is raised by the magnetic field generated at the front end of the mixing bar immersed into the solution and subsequently is suspended or re-suspended in solution, respectively, by repeated mixing movements of the mixing bar without a magnetic field generated at the front end of the mixing bar.

This embodiment can be suitably combined with single aspects and features of the embodiments described above and below, particularly concerning the structure of the mixing bar, the way of generating the magnetic field and the time schedule of mixing movement and generation of the magnetic field.

According to another embodiment an apparatus for suspending or re-suspending of magnetically attractive particles is provided. The apparatus comprises:

at least one mixing bar with a front end, whereby the mixing bar comprises a magnetic field generating apparatus for the optional generation of a magnetic field in the front end area;

whereby the apparatus for performing the method is constructed according to one of the embodiments described herein.

In the following, the invention is described by means of embodiments shown in the enclosed figures, from which embodiments further advantages and modifications are evident. However, the invention is not limited to the specifically described embodiments, but can be conveniently modified and altered. It is within the limits of the invention to appropriately combine single features and combinations of features of an embodiment with features and combinations of features of another embodiment in order to arrive at further embodiments according to the invention.

The embodiments shown in the figures are not true to scale but simply support the illustration of the corresponding embodiments. Thereby single features can be depicted on a larger or smaller scale. In the figures identical elements are provided with identical reference numerals.

Figure 1A:
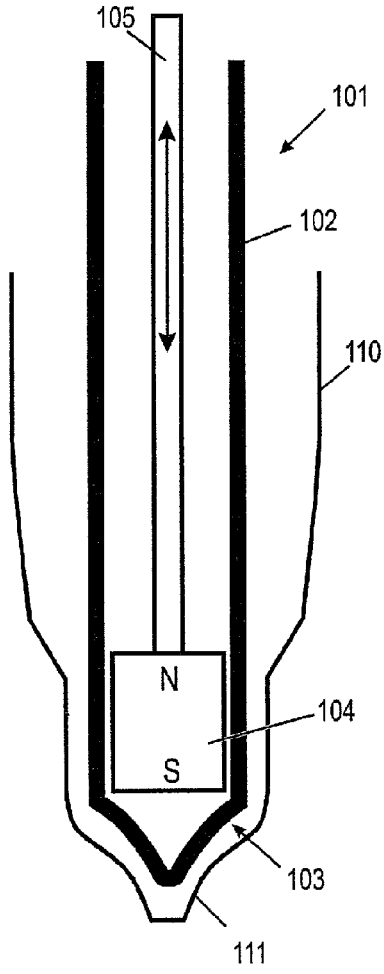
FIGS. 1A and 1B show a first and second embodiment of a mixing bar.

FIG. 1A shows a first embodiment of a mixing bar 101. The mixing bar can for example have an elongated cylindric shape. The mixing bar 101 for example has a cylindric or rotationally symmetric outer cover 102 typically consisting of non-magnetic material. The material of cover 102 should preferably be selected such that it does not or just marginally weakens magnetic fields. For example, the cover 102 can consist of an inert synthetic material being for example to a large extent dimensionally stable. In order to reach dimensional stability, the thickness of the material of cover 102 can suitably be selected. It is also possible to reinforce the cover by additional structures, for example at the inside of the cover 102, whereby the structures may then consist of another material than the cover 102. Composite materials are also possible. Additionally, the cover 102 can be structured at its outer side. At its front end 103 the cover is typically closed. This end simultaneously constitutes the front end 103 of the mixing bar 101.

In the mixing bar 101 according to the first embodiment a permanent magnet 104 is movably arranged within the cover 102, particularly in the longitudinal direction of the cover 102. The permanent magnet 104 can be moved in the cover 102 in longitudinal direction by means of a bar 105, i.e. it can particularly be taken out of the front end area 103 and again into the front end area 103. This happens for example by means of a suitable device of operation not illustrated here. The mixing bar 101 is also movable for example in longitudinal direction. Thereby mixing bar 101 and permanent magnet 104 can be moved independently of each other. The movable permanent magnet 104 represents in this embodiment the magnetic field generating apparatus.

The mixing bar 101 can be inserted in a mixing vessel 110 as shown in FIG. 1A. The mixing vessel 110 can for example consist of a dimensionally stable soft material that can be partially flexible. For example, a synthetic material can be used for the mixing vessel. Thereby the material of the mixing vessels) 110 can be softer than the material of the cover 102. Typically several mixing vessels 110 placed next to each other can be combined to a plate that is not illustrated here.

FIG. 1A shows a mixing vessel 110 with a pointed, for instance tapered bottom 111. The front end 103 of the mixing bar 101 can be adapted to the shape of the mixing vessel 110 and can be pointed, for example tapered as well. Other shapes for the bottom 111 of the mixing vessel and the front end 103 of the mixing bar are also possible, for example concave, conical, flat or round. Generally free formed surfaces are also thinkable as a shape for the bottom 111 of the mixing vessel and the front end 103 of the mixing bar, although these are less preferred for reasons of construction, production and procedure. It is advantageous if the permanent magnet 104 has a vertical dimension such determined that its top (its north pole N in the depicted example) is always above the liquid level even when the mixing bar 103 is totally immersed.

The permanent magnet 104 produces a magnetic field according to the embodiment illustrated in FIG. 1A that primarily extends in longitudinal direction of the mixing bar 110. This is indicated in FIG. 1A by the arrangement of the poles (north and south). It is also possible that the magnetic field shows another orientation, for example a lateral orientation in relation to the longitudinal dimension of the mixing bar 101. The permanent magnet 104 is illustrated in FIG. 1A comparatively short in longitudinal direction of the mixing bar 101. It is also possible that the permanent magnet 104 has another dimension in longitudinal direction, for example that it is considerably longer. Additionally, the permanent magnet 104 can be formed by two or more permanent magnets.

The spatial position of the magnetic field generated by the permanent magnet 104 in relation to the front end 103 of the mixing bar 101 can be modified by displacing the permanent magnet 104. When the permanent magnet 104 is displaced to the front end 103 of the mixing bar 101, the magnetic field generated by the permanent magnet 104 is effective there. An "effective" magnetic field is therefore "switched on" at the front end of the mixing bar 101. However, if the permanent magnet 104 is far enough removed from the front end 103 of the mixing bar 101, the effectiveness of the magnetic field generated by the permanent magnet 104 at the front end 103 is weakened such that there is no longer an effective magnetic field present for raising magnetically attractable particles. The magnetic field is therefore "switched off" at the front end 103 of the mixing bar 101.

Figure 1B:
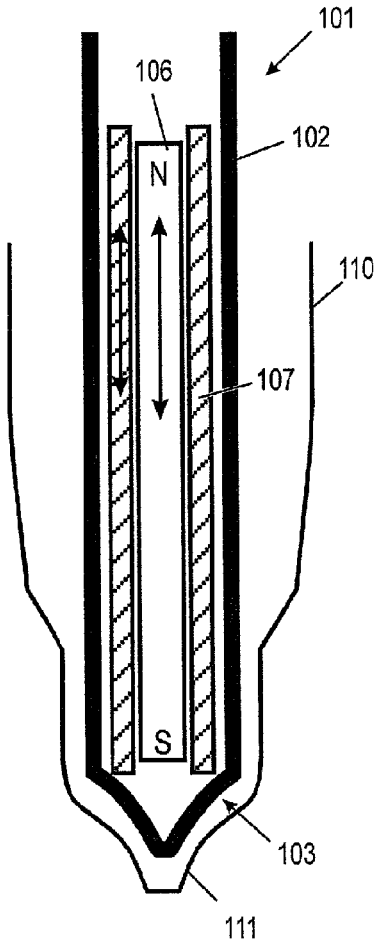

Another embodiment for switching on and off the magnetic field is shown in FIG. 1B. This comprises a comparatively long permanent magnet 106 in longitudinal direction compared to the permanent magnet 104 in FIG. 1A, which is surrounded by a protection cover 107 made for example of ferromagnetic material. Both the permanent magnet 106 and the protection cover 107 can be movably arranged in longitudinal direction of the mixing bar 101 and can be independently moved by corresponding devices of operation not illustrated here. For "switching on" the magnetic field, for example the protection cover 107 can be retracted from the front end 103 in order to uncover the south pole of the permanent magnet 106 illustrated here. By doing so the streamlines of the field can penetrade the cover 102 and proceed beyond the mixing bar 101. For "switching off" the magnetic field the protection cover 107 is again placed over the permanent magnet 106, thereby shielding the magnetic field generated by the permanent magnet towards the periphery. Alternatively, the permanent magnet 106 can be retracted as well from the front end 103. In this embodiment the permanent magnet 106 represents along with the protection cover 107 the magnetic field generating apparatus.

Figure 2:
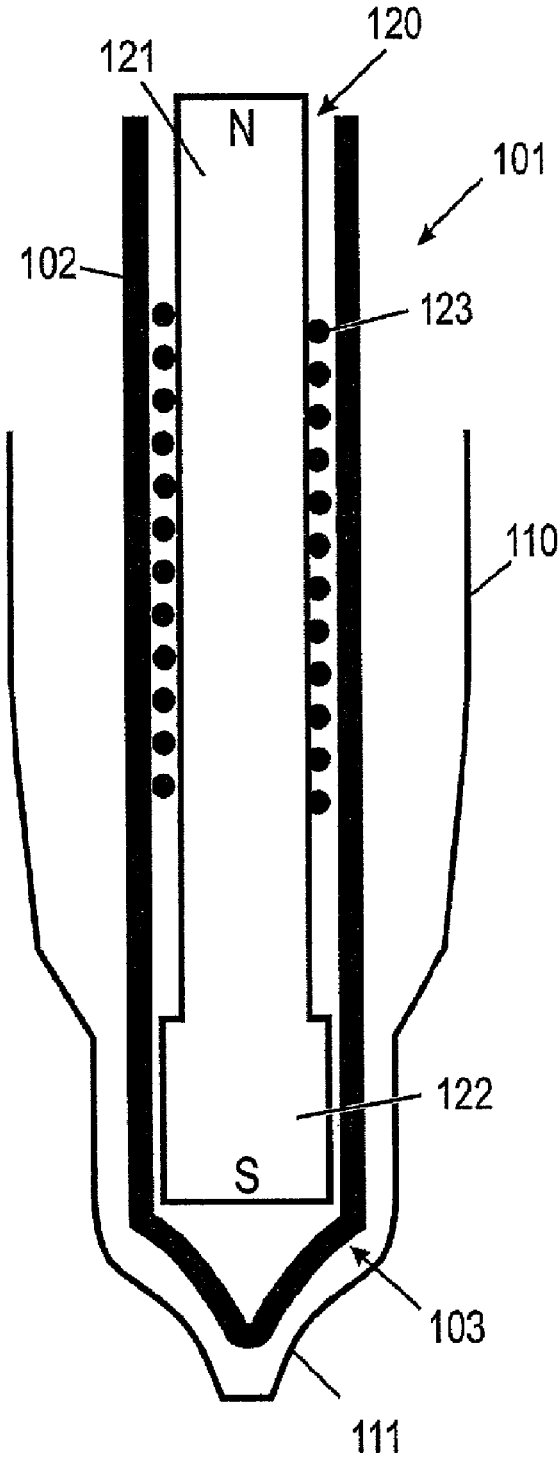
FIG. 2 shows a third embodiment of a mixing bar.

The embodiments shown in FIGS. 1A and 1B cause the switching on and switching off of the magnetic field by displacing permanent magnets or protection covers, respectively. By contrast FIG. 2 shows an embodiment in which the magnetic field is generated by a solenoid 120. The solenoid 120 has a core 121 for example with a bulky front end 122. The core 121 is enclosed by a coil 123, through which current can flow for generating a magnetic field. Switching the magnetic field on and off takes place here by the corresponding switching on and off of the current. Mechanical devices of operation for moving a permanent magnet or a protection cover, respectively, are not necessary in the embodiment described here. The magnetic field generating apparatus is represented in this embodiment by the solenoid 120. Generally any kind of magnetic field generating apparatus is suitable for application in the method according to the invention as long as it allows a magnetic field to be switched on and off.

With regard to the FIGS. 3A to 3E one embodiment of the method according to the invention is to be described below. Thereby a mixing bar shown in FIG. 1A is used, but with long permanent magnet. However, it is also possible to use the other mixing bars shown in FIGS. 1B and 2 or differently constructed mixing bars. It just has to be noted that the mixing bar allows an optional generation of a magnetic field at least at its front end.

At first a mixing vessel 10 is provided. The mixing vessel 10 can contain a predominantly liquid mixture 30 with magnetically attractable particles 40 present therein. In the following, only particles are mentioned. For example, particles 40 can be particles 40 precipitated from the mixture. The particles 40 have accumulated at the bottom 11 of the mixing vessel 10. Alternatively it is possible that the mixing vessel 10 without mixture 30, but only with the particles 40 present at the bottom 11 is provided either as powder or in suspension, and that the mixture 30 is then transferred into the mixing vessel 10.

Particles 40 can be particles or beads that are attracted by a magnetic field, i.e. they comprise for example a ferro-, ferri-, para-or superparamagnetic material and have at least partially a surface that is able to bind contaminants or biological target molecules like nucleic acids or proteins. The surface capable of binding can thereby be built by the magnetic material itself or at least partially often even totally by a non-magnetic material, for example a polymer or a $SiO_2$-containing material, that can also be functionalized. The particles have a typical particle-diameter of about 500 nm to 25 μm, preferably of about 1 to 20 μm and particularly preferred of about 4 to 16 μm. It is self-evident that the particles have a certain particle size distribution. In some cases the surfaces of the particles 40 are functionalized with the functionalization depending on the concrete analytic or diagnostic application, respectively, and being irrelevant for the method according to the invention. Such magnetic particles are already known with different designs and for different applications from the state of the art.

The mixture 30 can be any homogeneous or heterogeneous mixture which can exist in the described embodiments and shows a sufficiently low viscosity in order to allow the performance of the method according to the invention. Particularly these are mixtures which have a considerable portion of liquid components. For example, it can be a lysing, binding, washing or eluting solution or a mixture containing the specific, mostly biological substances or contaminants to be examined or separated. If the mixture is a biological sample it can be available untreated or pre-treated, for example as a lysate, and contain solid components like cell remnants. The type of mixture is irrelevant for the performance of the method.

In the mixture 30 a mixing bar 1 is immersed with its front end 3 ahead directed towards the bottom 11 of the mixing vessel 10. This is carried out for example by lowering the mixing bar 1 along its longitudinal dimension. The downward movement of the mixing bar 1 is indicated by an arrow in FIG. 3A. The front end 3 of the mixing bar 1 can however already be immersed in the mixture 30 and is then simply lowered.

Figure 3A:
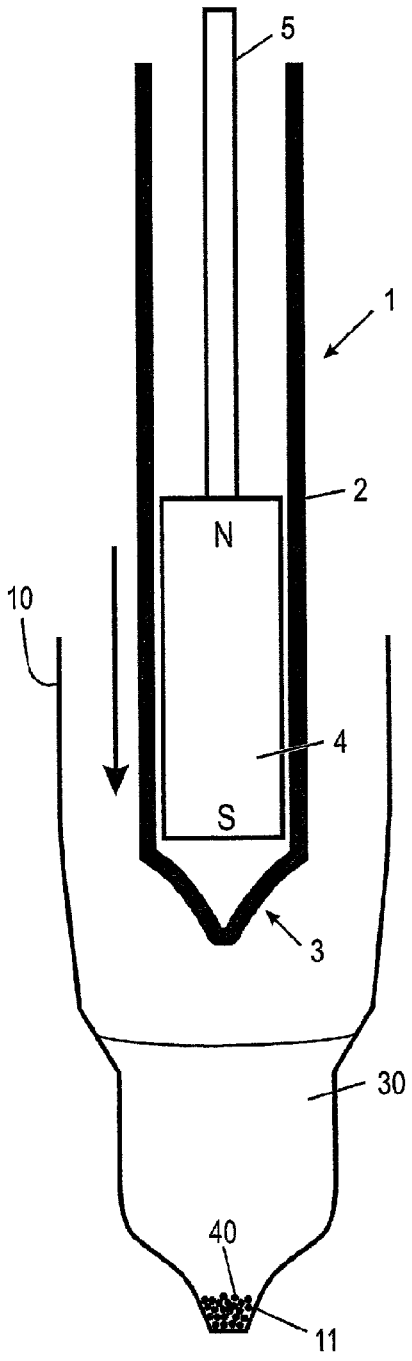
FIGS. 3A to 3E show single operational sequences of an embodiment of the method according to the invention.
Figure 3B:
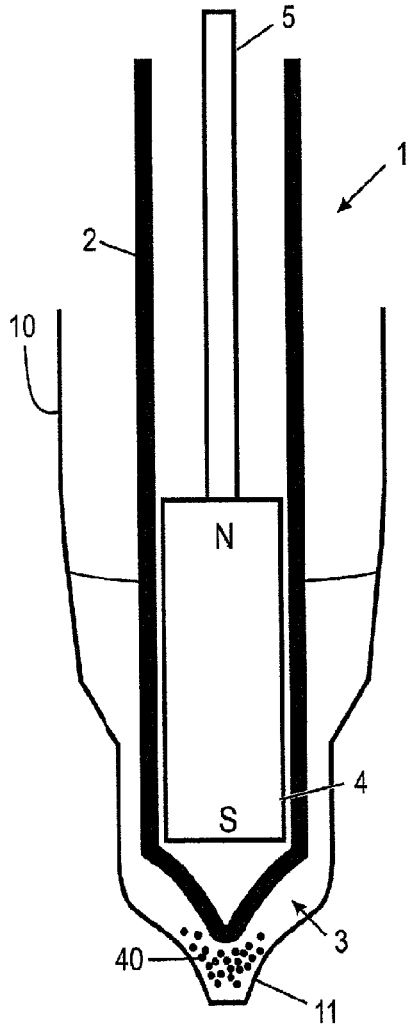

Simultaneously with the lowering of the mixing bar 1 the permanent magnet 4 can be slid (moved) to the front end 3 of the mixing bar 1 by activation of the bar 5 so that a sufficiently strong magnetic field is generated there. The permanent magnet 3 can already be at the front end 3 of the mixing bar 1 when the mixing bar is lowered. Irrespective of the way how the permanent magnet 3 is taken to the front end 3 of the mixing bar 1, the permanent magnet is at least intermittently then at the front end 3, if the mixing bar 1 is close to the bottom 11 of the mixing vessel 10. This situation is illustrated in FIG. 3B. As indicated there, the front end 3 of the mixing bar 1 preferably does not touch the bottom 11 of the mixing vessel but is to some extent, typically defined, spaced apart from it. This ensures on the one hand that there is a certain range in the relatively vertical arrangement of the mixing vessel 10 to the mixing bar 1. On the other hand, in parallel processing of several mixing vessels 10 combined for example to multi-well-plates, production tolerances of the individual mixing vessels can be compensated particularly in plates of synthetic material with integrally shaped mixing vessels. Finally, it can be avoided that the mixing bar knocks against the bottom and thus damages the mixing vessel 10 possibly resulting in the discharge of the mixture. For example, the mixing bar can be brought to the bottom 11 of the mixing vessel to about 0.5 to 2 mm. This distance turns out to be sufficient for most of the applications in order to avoid collisions between the mixing bar and the bottom of the mixing vessel. Preferably, the distance to the bottom is 0.1 to 2 mm, more preferably 0.3 to 1 mm, and most preferably 0.5 to 0.6 mm.

Figure 3C:
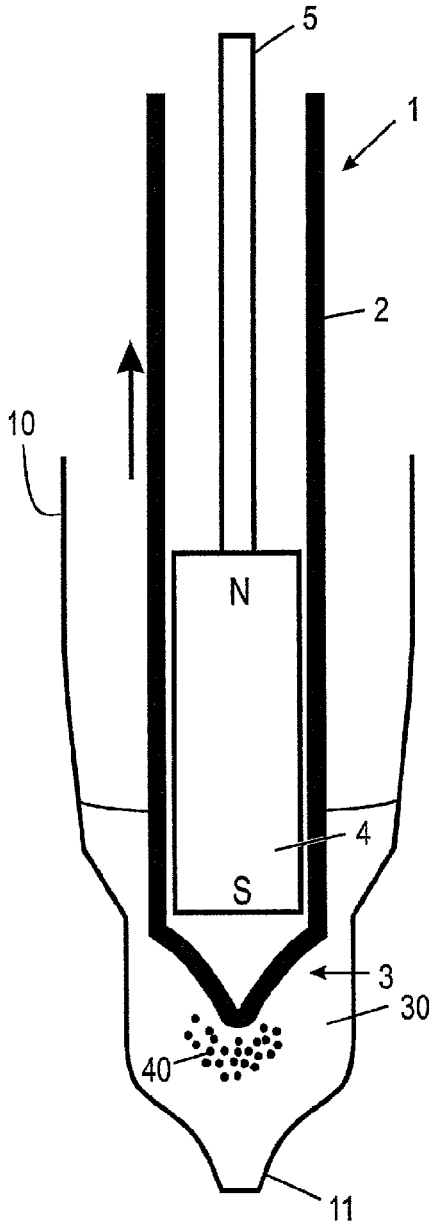

As shown in FIG. 3B, the particles 40 are attracted by the magnetic field generated by the permanent magnet 4 at the front end area 3 of the mixing bar 1, thereby moving away from the bottom into the mixture but clinging only to a minor degree to the outer surface of the mixing bar 1 or the cover 2, respectively. Thereby the particles 40 are raised from the bottom 11 and can be pulled away from the bottom by the mixing bar 1. For that purpose the mixing bar 1 is pulled up along with the permanent magnet 4 present at the front end 3, as indicated in FIG. 3C by an arrow. This upward movement can occur comparatively slowly to avoid dissociation of the adherent particles 40 from the mixing bar 1. The movement should be not too slow, however, because otherwise the portion of the particles clinging to the mixing bar can then become too great.

If the mixing bar is pulled up far enough whereby the front end 3 of the mixing bar with the particles 40 clinging to it shall remain immersed in the mixture 3, the permanent magnet 4 is also pulled up by the bar 5 relatively to the cover 2, i.e. away from the front end 3 of the mixing bar. Thereby the permanent magnet 4 can be pulled up comparatively fast, for example jerkily. Jerky preferably means that the magnet has a velocity by which it covers a distance of 100 mm in a time between 0.05 to 1 s, more preferably 0.2 to 0.4 s and most preferably 0.25 to 0.3 s. Since the data given above just serve the description of the velocity, the way can therefore also constitute n*100 mm with n>0 and with the associated process times in this case also being multiplied by n. The goal of this procedure is to minimize or to switch off the effect of the magnetic field at the front end 3 of the mixing bar 1 sufficiently fast so that the particles are no longer attracted by the mixing bar 1. By removing the permanent magnet 4 from the front end 3, the magnetic field is weakened there and is no longer strong enough to attract the particles 40. Thereby the particles 40 are released, i.e. the direction of movement of the particles is no longer determined by the magnetic field.

Figure 3D:
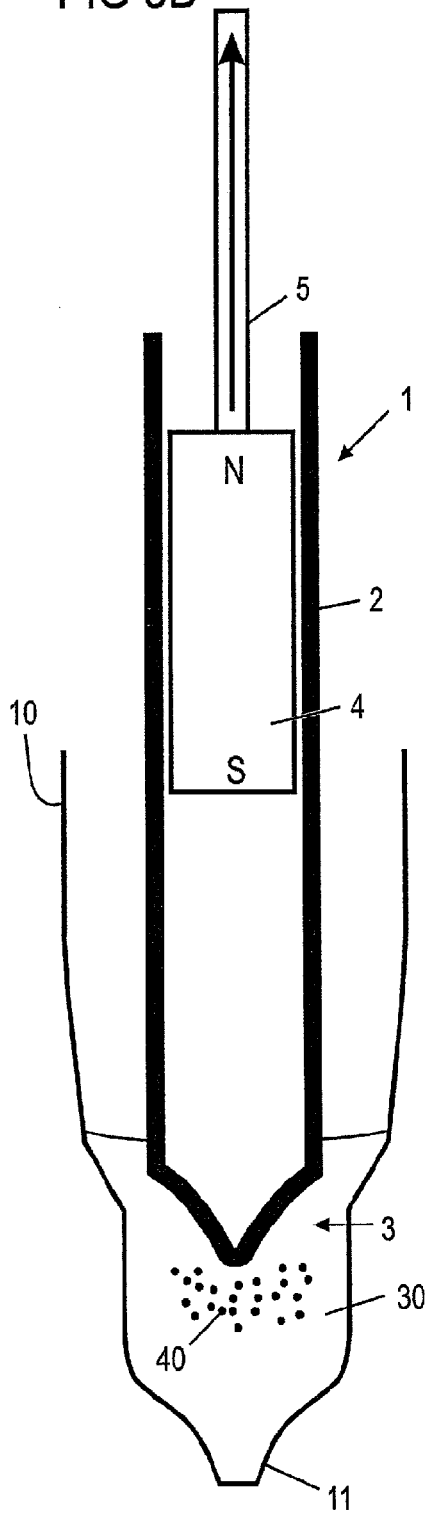

In order to avoid that, by pulling up the permanent magnet 4, the particles 40 which are still in suspension or belong to the part of the particles still clinging to the mixing bar, migrate upward along the outer surface of the mixing bar 1, the permanent magnet 4 should be withdrawn sufficiently fast from the front end 3 of the mixing bar 1 so that the particles 40 are not able to follow the movement due to friction and the viscosity of the mixture 30. The preferably conical front end of the mixing bar 3 also counteracts the "migration" of the particles 40. The comparatively fast pulling up of the permanent magnet 4 is indicated in FIG. 3D by a long arrow. Typically the permanent magnet 4 is taken to a position above the mixture 30 so that no effective magnetic field is generated in the mixture 30.

In analytic and diagnostic tests typically comparatively small amounts of liquid or solution, respectively, are used, for example a few milliliters. For example the mixing vessel 10 can be filled up to the height of for example about 15 mm calculated from the bottom 11. The particles 40 can then be taken to a height of about 10 mm for example and can be released there.

Pulling up the mixing bar 1 and the permanent magnet 4 does not have to be exactly carried out in the way described above. It is also possible to withdraw the permanent magnet 4 at least partially and a little time-staggered already when the mixing bar 1 is pulled up. Independent from the actual chosen way, the goal is to pick up the particles 40 from the bottom 11 and to take them further "upward", i.e. away from the bottom of the mixing vessel, so that they can then be easier suspended in the mixture 30. Thereby nearly all particles 40 precipitated on the bottom 11 are to be picked up by the mixing bar 1.

The particles 40 should preferably not cling or just cling in small amounts to the mixing bar 1. For a most optimal suspension of the particles it is sufficient to raise them far enough from the bottom 11 by the effect of the magnetic field. Furthermore it is sufficient to raise the particles 40 so far that afterwards they can be easily distributed in the mixture by the subsequently beginning mixing movement of the mixing bar 1.

Figure 3E:
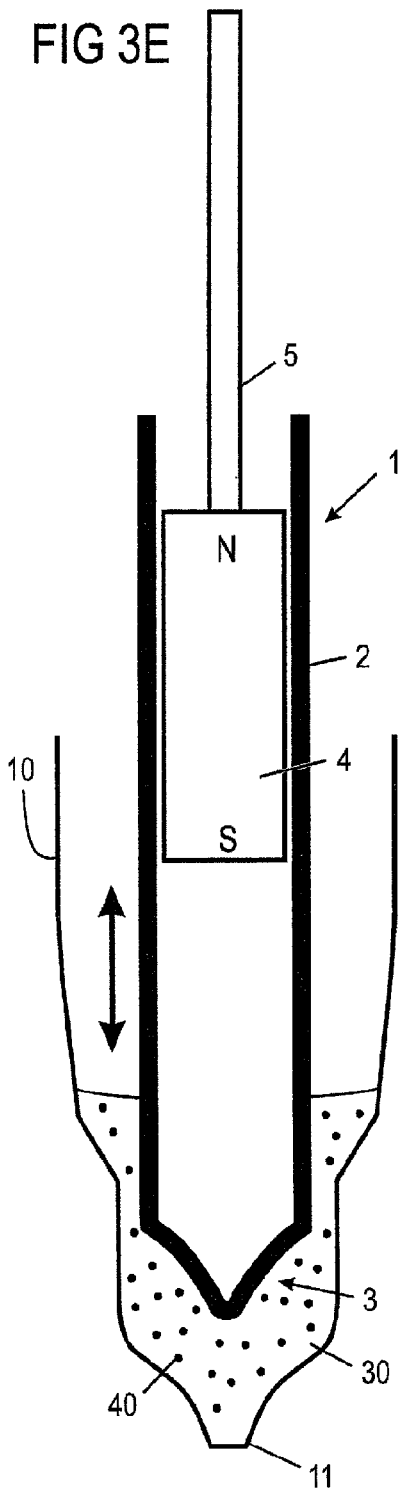

The mixing movement of the mixing bar 1 following the "switching on" of the magnetic field at the front end 3 of the mixing bar is shown in FIG. 3E. In this embodiment of the method, the mixing bar 1 is repeatedly moving up and down thereby distributing the raised particles 40 in the mixture 30. The lift of the mixing movement as well as the frequency are adapted such that on the one hand a sufficient mixing is guaranteed and on the other hand "slopping" of the mixture from one mixing vessel into an adjacent mixing vessel is definitely avoided. For example, the mixing movement can be carried out with a frequency of about 1 Hz to about 20 Hz. The mixing movement of the mixing bar 1 is particularly effective if the mixing bar displaces a considerable portion of the solution volume because thereby the liquid level migrates. The alteration of the liquid level can clearly be seen when comparing FIGS. 3A and 3B. Particularly the mixing movement can also occur in a softer way compared to such mixing devices at which an uptake of the particles 40 supported by a magnetic field does not occur and which need more vehement mixing movements in order to whirl up the precipitated particles. The lift of the mixing bar 1 during the mixing procedure can be for example 30 to 100% of the liquid column.

Other mixing movements, for example a rotation of the mixing bar 1, are also possible. However, rotational movements demand a higher mechanical complexity than lift movements particularly in parallel processing of several mixing vessels with respectively dedicated mixing bar. Therefore in corresponding devices or robots, respectively, with many mixing bars arranged for example in an array these mixing bars are preferably movable just along their longitudinal dimension, especially since such a movement is already necessary for inserting the mixing bars so that no additional mechanics is required.

As a result, the particles 40 are, according to the method of the invention, as indicated in FIG. 3E, to a great extent uniformly suspended or re-suspended, respectively, in the total volume of the mixture 30 up to and including higher than the front end 3. Thereby the capabilities can be better utilized.

Figure 4A:
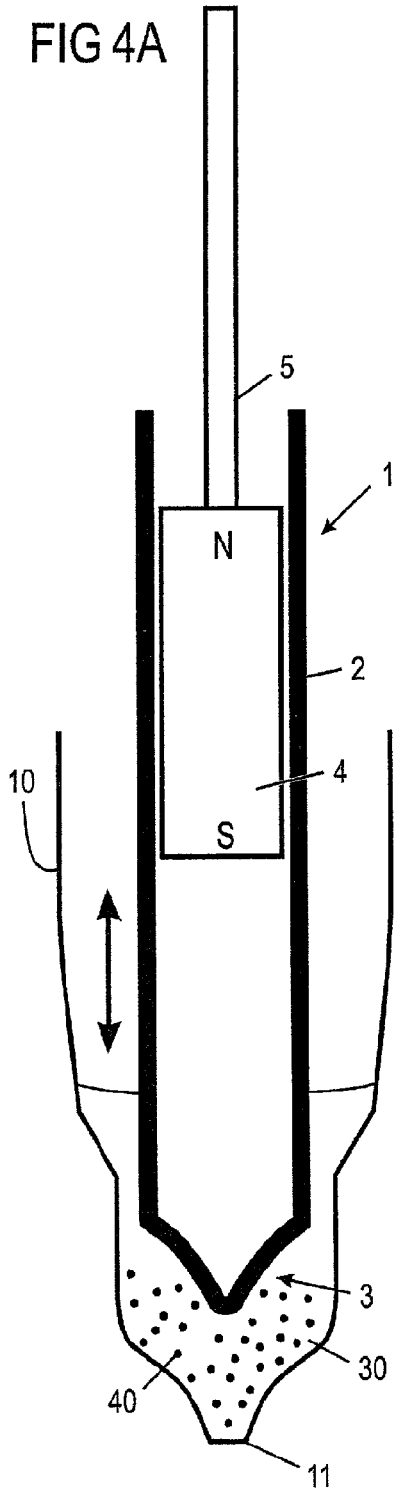
FIGS. 4A to 4E show single operational sequences of another embodiment of the method according to the invention.

If a partial re-sedimentation of the particles 40 occurs in spite of the mixing movement, the precipitated particles 40 can be re-taken by the permanent magnet 4. A partial sedimentation is indicated in FIG. 4A. Irrespective of whether a potential partial sedimentation occurs, the particles 40 can again be raised sufficiently far by switching on the magnetic field again after a definite time or in regular intervals, thereby allowing a safe suspending or re-suspending, respectively, of the particles 40.

Figure 4B:
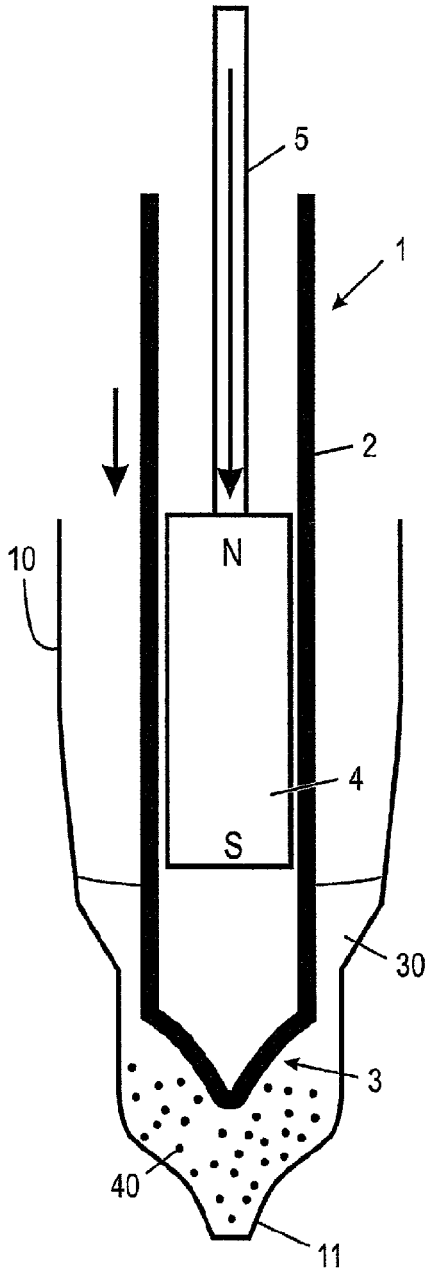

In order to possibly take up the particles 40, the permanent magnet 4 is moved towards the front end 3 of the mixing bar 1, for example during a downward movement of the mixing bar 1, in order to generate a sufficiently strong magnetic field there. The movement of the permanent magnet 4, activated by the bar 5 and an operational device not illustrated here, is indicated in FIG. 4B by a long arrow. In the embodiment illustrated there its length is to represent the velocity and the lift of the downward movement, which are higher than the velocity or greater than the lift of the downward movement of the mixing bar 1, respectively, if the mixing bar 1 does not move at the same time as the permanent magnet 4, but the permanent magnet 4 moves towards the mixing bar 1, so that preferably the permanent magnet 4 and the mixing bar 1 simultaneously arrive at the bottom of the vessel.

Figure 4C:
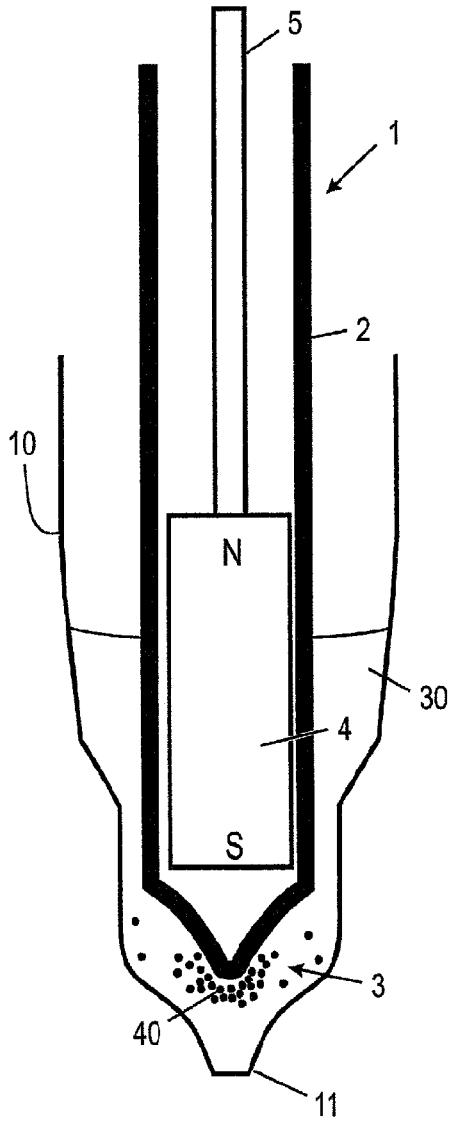
Figure 4D:
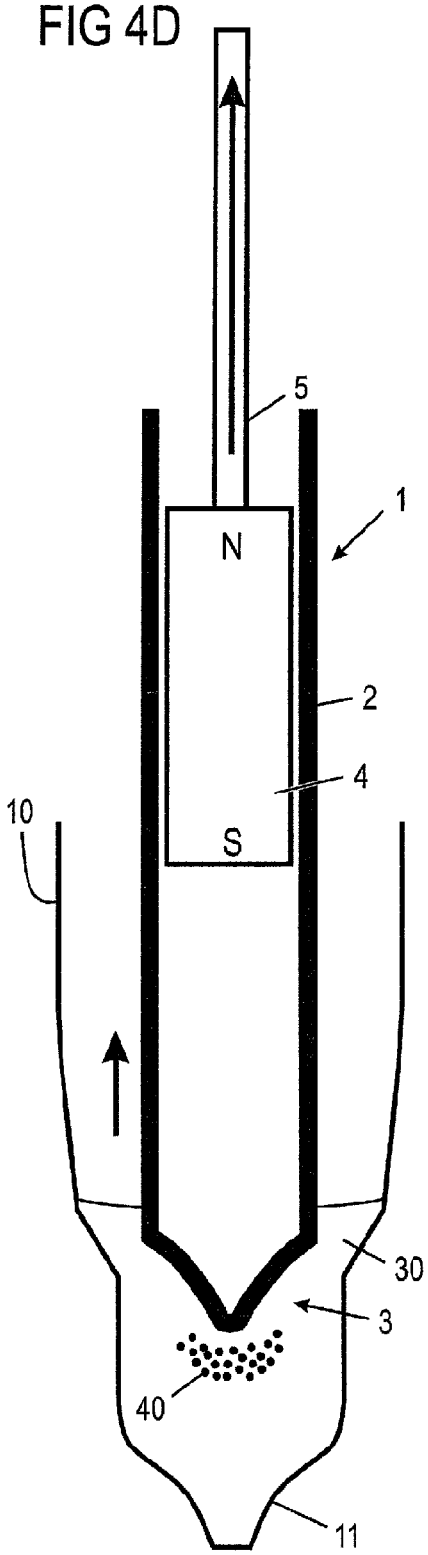
Figure 4E:
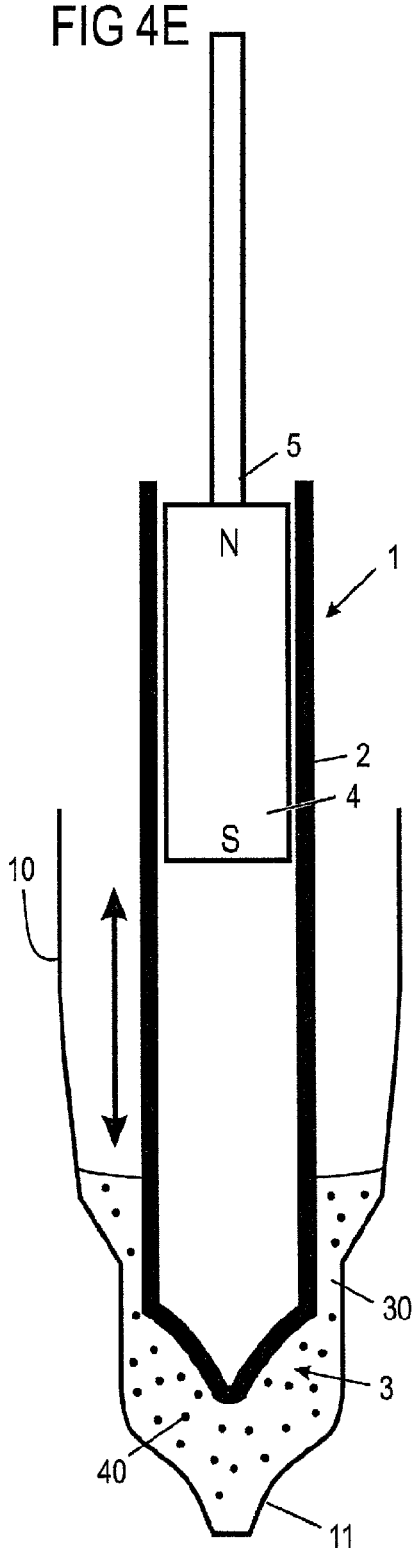

FIG. 4C illustrates that the particles 40 are again withdrawn from the bottom into the mixture by the front end 3 of the mixing bar 1. By pulling up the mixing bar 1 indicated in FIG. 4D with the subsequent rapid powering up of the permanent magnet 4, the particles 40 raised from the front end 3 are again taken to a definite height and released there. Afterwards another mixing movement of the mixing bar 1 follows. This is indicated in FIG. 4E.

The re-picking up or re-suspending, respectively, of the particles 40 by the mixing bar can be accomplished for example during an upward and downward movement of the mixing movement. It is also possible that the mixing movement is interrupted or slowed down for picking up, in order not to constrain suspending by the mixing movement.

Figure 5:
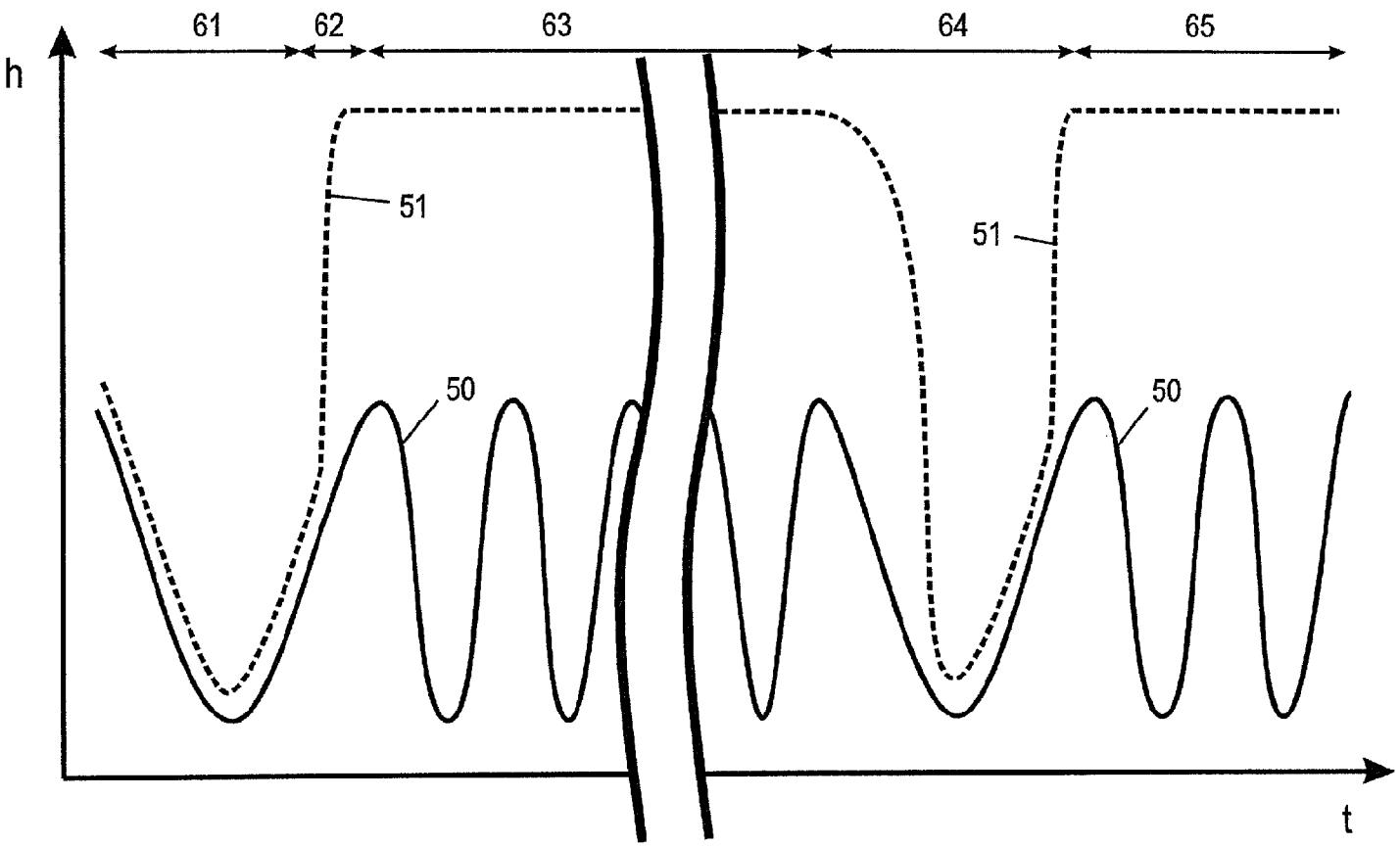
FIG. 5 shows a lift diagram of a mixing bar with movable permanent magnet corresponding to another embodiment of the method according to the invention.

For clarification of this situation reference is made to FIG. 5, which illustrates a lift diagram for the lift movement of the mixing bar 1 and the permanent magnet 4. Thereby, curve 50 shows the lift movement of the mixing bar or the cover 2, respectively, and curve 51 the lift movement of the permanent magnet 4 in relation to the time t. The lift heights h are relatively illustrated to a separate benchmark, for example the bottom 11 of the mixing vessel 10.

In a first phase 61 the cover 2 and the permanent magnet 3 are moved together downward and then again together upward to a predefined height, with the permanent magnet 4 being located in the front end area 3 of the mixing bar. This lift movement can be carried out comparatively slowly and serves the lifting of the precipitated particles 40 which are taken to the predefined height. Then in a second phase 62 a fast movement of the permanent magnet 4 away from the front end 3 of the cover 2 or the mixing bar 1, respectively, occurs while the cover 2 can also be pulled up a little. By rapidly pulling up the permanent magnet 4 from the front end 3 the particles are released. A third phase 63 follows in which primarily only the cover 2 is moved to generate a mixing movement. It is also possible to move the permanent magnet 4 as well, whereby it should have a sufficient distance to the liquid surface of the mixture 30. The mixing movement is illustrated in FIG. 5 by periodical or oscillating lift movements.

Optionally, a renewed lifting and suspending of the particles 40 can follow. This is indicated by the phase 64 in which a slower lift movement compared to the mixing movements occurs and the permanent magnet 4 can be asymmetrically moved to the lift movement of the cover 2 or the mixing bar 1, respectively. Thereby the permanent magnet 4 is for example very rapidly moved towards the front end 3, if the front end 3 of the mixing bar 1 is located close to the bottom 11 of the mixing vessel 10. This should prevent that still suspended particles are re-pulled downward. Then the upward movement of the cover 2 occurs along with the permanent magnet 4, which is not rapidly withdrawn again from the front end 3 of the mixing bar until it has reached a defined height. Then re-mixing without magnetic field follows in phase 65.

The phases shown in FIG. 5 can merge as well. For example, it is possible to accomplish the magnetic field supported raising of the particles during mixing movement.

The invention is not limited to the embodiments described above but comprises appropriate modifications within the scope disclosed by the claims. The appended claims are to be understood as a first, not binding approach to describe the invention with general terms.

List of Reference Numerals

1, 101 mixing bar
2, 102 cover
3, 103 front end of the mixing bar
4, 104 permanent magnet
5, 105 bar
106 permanent magnet
107 protection cover
10, 110 mixing vessel
11, 111 bottom of the mixing vessel
30 mixture
40 particle
50 lift curve of the mixing vessel
51 lift curve of the permanent magnet
61 first phase
62 second phase
63 third phase
64 fourth phase
65 fifth phase
120 solenoid
121 core
122 end of the solenoid
123 coil

The invention claimed is:

1. A method for suspending or re-suspending magnetically attractable particles comprising:

Providing of at least one mixing vessel filled at least partially with a mixture comprising magnetically attractable particles which are at least partially precipitated at the bottom of the mixing vessel Providing of at least one mixing bar with a front end directed to the bottom of the mixing vessel, wherein the mixing bar has a magnetic field generating apparatus for the optional generation of a magnetic field at least in the front end area;

Switching on an effective magnetic field acting at least in the front end area of the mixing bar by means of the magnetic field generating apparatus, while the mixing bar is immersed in the mixture;

Moving away the magnetic field together with the mixing bar from a bottom of the mixing vessel with the movement of the magnetic field together with the mixing bar being such that at least a part of the magnetically attractable particles is raised from the bottom of the mixing vessel, and that a portion of particles sticking at the mixing bar is minimized;

Switching off the magnetic field in a previously determined distance from the bottom which is greater than a distance from the bottom when switching on the magnetic field;

Performing repeated mixing movements of the mixing bar without existence of a magnetic field switched on at the front end of the mixing bar in order to suspend or re-suspend, respectively, the magnetically attractable particles present in the mixture.

2. The method according to claim 1, whereby after repeated mixing movements, the magnetic field is re-generated at the front end of the mixing bar in order to re-raise magnetically attractable particles.

3. The method according to claim 2, whereby the mixing bar comprises a solenoid in order to generate the magnetic field.

4. The method according to claim 2, whereby the magnetically attractable particles are ferro-, ferri-, paramagnetic and/or superparamagnetic particles.

5. The method according to claim 1, whereby the mixing bar is reciprocated along a longitudinal direction thereof for mixing.

6. The method according to claim 5, whereby the mixing bar comprises a solenoid in order to generate the magnetic field.

7. The method according to claim 5, whereby the magnetically attractable particles are ferro-, ferri-, paramagnetic and/or superparamagnetic particles.

8. The method according to claim 1, whereby the magnetic field at the front end of the mixing bar is switched on at least at a time when the mixing bar is located with the front end thereof in a defined minimal distance to the bottom of the mixing vessel.

9. The method according to claim 8, whereby the mixing bar comprises a solenoid in order to generate the magnetic field.

10. The method according to claim 8, whereby the magnetically attractable particles are ferro-, ferri-, paramagnetic and/or superparamagnetic particles.

11. The method according to claim 1, whereby the mixing bar comprises at least one permanent magnet which is movable in a longitudinal direction of the mixing bar.

12. The method according to claim 11, whereby for switching on the magnetic field in the front end area of the mixing bar, the permanent magnet is moved towards the front end of the mixing bar and for switching off the magnetic field, the permanent magnet is moved away from the front end.

13. The method according to claim 11, whereby the permanent magnet is jerkily moved away from the front end of the mixing bar when the magnetic field is switched off.

14. The method according to claim 13, whereby the magnetically attractable particles are ferro-, ferri-, paramagnetic and/or superparamagnetic particles.

15. The method according to claim 11, whereby the magnetically attractable particles are ferro-, ferri-, paramagnetic and/or superparamagnetic particles.

16. The method according to claim 1, whereby the mixing bar has at least one permanent magnet in said front end area and at least one protection cover surrounding the permanent magnet and being movable in a longitudinal direction of the mixing bar.

17. The method according to claim 16, whereby the magnetically attractable particles are ferro-, ferri-, paramagnetic and/or superparamagnetic particles.

18. The method according to claim 1, whereby the mixing bar comprises a solenoid in order to generate the magnetic field.

19. The method according to claim 1, whereby the magnetically attractable particles are ferro-, ferri-, paramagnetic and/or superparamagnetic particles.

* * * * *